United States Patent [19]

Hughes

[11] Patent Number: 4,782,844

[45] Date of Patent: Nov. 8, 1988

[54] TEXTURE REMOVAL APPARATUS

[75] Inventor: Joel Hughes, Wilmington, N.C.

[73] Assignee: Container Products Corp., Wilmington, N.C.

[21] Appl. No.: 31,360

[22] Filed: Mar. 30, 1987

[51] Int. Cl.[4] ..... B08B 3/10

[52] U.S. Cl. ..... 134/184; 134/201; 114/222; 15/302

[58] Field of Search ..... 134/115 R, 104, 172, 134/182, 183, 184, 201; 51/424, 180, 174, 175, 176, 177, 273; 114/222, 270; 15/302

[56] References Cited

U.S. PATENT DOCUMENTS

| | | | |
|---|---|---|---|
| 2,628,456 | 2/1953 | Berg | 51/424 |
| 3,673,744 | 7/1972 | Oimoen | 51/273 X |
| 4,149,345 | 4/1979 | Atsuchi | 114/222 X |
| 4,444,146 | 4/1984 | Dewitz et al. | 134/184 X |
| 4,563,840 | 1/1986 | Urakami | 51/424 |
| 4,591,390 | 5/1986 | Scott et al. | 15/302 |

*Primary Examiner*—Harvey C. Hornsby
*Assistant Examiner*—Frankie L. Stinson

[57] ABSTRACT

An apparatus for removing surface material such as contaminated textures including asbestos and the like from walls and ceiling structures, and for preventing the removed material from escaping into the ambient environment. The apparatus provides a portable shroud enclosing a material removal member which could be a shredding head or an emitter of sonic, ultrasonic or ultraphonic signals. A liquid or coagulant spray manifold will operate in close proximity to the material remover and is utilized to capture and retain air borne microscopic particles. The material remover and spray manifold are mounted on a power carrier which is adapted to reciprocally move these elements within the shroud and above a material receiving hopper. A vacuum recovery system acts in cooperation with the hopper to retrieve and retain for disposal the removed surface material.

8 Claims, 6 Drawing Sheets

TEXTURE REMOVAL APPARATUS

SUMMARY OF THE INVENTION

This invention relates to improvments in material removal equipment which provides recovery and disposable means for the removed material. It is especially advantageous in the removal, recovery and disposition of contaminated material such as asbestos used in insulation in buildings.

Among the dangers present in the use of commonly known material removal equipment is the danger of silicosis contacted from breathing the shredded material laden air, as well as the danger of falls from sliding on the dislodged material collected on stagings, decks and other surrounding surfaces. In certain environments there is danger to exposed machinery and other equipment that are subject to deleterious effect of the dust laden air.

An object of this invention is to provide a remote controlled portable self-contained apparatus for removing textured material from walls and ceilings. The apparatus includes a shroud providing a sealed area from which the material is removed. A material removing device is adapted to be carried within the shroud and reciprocally moved therethrough in a linear path.

Cooperating with the shroud is a collection hopper that is in communication with a vacuum and filtration system whereby the removed material is collected and contained for safe disposal.

Other objects of the invention will be here and after made apparent.

BRIEF DESCRIPTION OF THE DRAWINGS

This invention will be best understood by reference to the accompanying drawings which illustrate the preferred construction and mode of operation by which the stated objects of the invention are achieved and in which.

GENERAL DESCRIPTION

Figure 1:
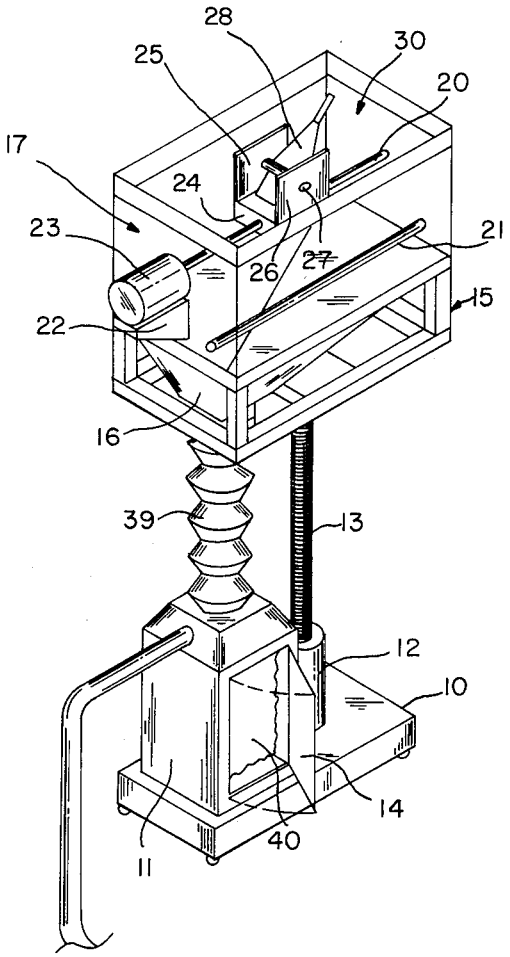
FIG. 1 is a perspective view of one embodiment of the invention.

In the embodiment shown in FIG. 1 a wheeled remote controlled cart 10 supports a cabinet 11 and forms the base for a power lift mechanism 12, which could be a telescopic worm drive shaft 13. The cabinet 11, is provided with an access door 14, through which a disposable waste container may be placed in the recovery vacuum system of the apparatus.

Supported by the shaft 13 is a frame structure 15 that includes a chute 16 that in turn has open communication with an open top box-like hopper 17.

Figure 2:
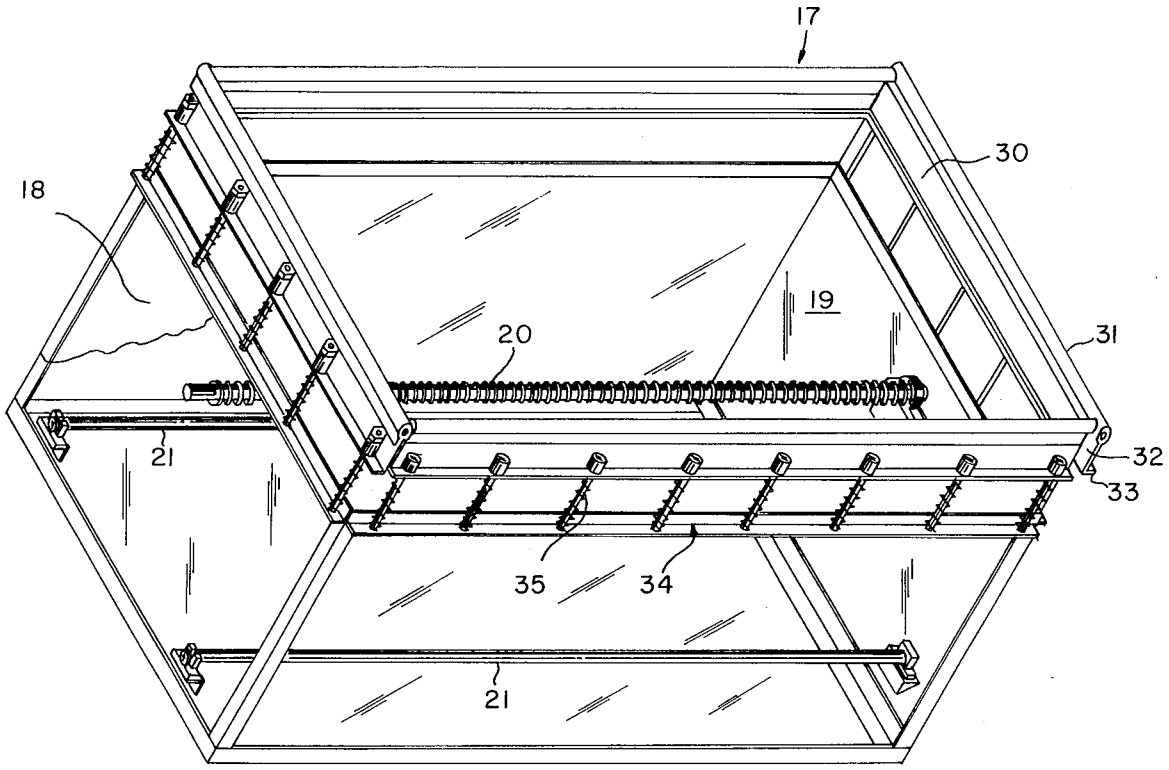
FIG. 2 is a perspective view of the shroud assembly for the invention.

As shown is FIG. 2 the hopper 17 houses a rotatable worm gear 20 and a pair of structural supporting struts 21. The worm gear is operably connected to a reversible electric motor 23 mounted on an exterior platform 22 as shown in FIG. 1.

Threadably mounted on the worm gear 20 is a generally U-shaped bracket 24. Extending between the spaced parallel walls 25 and 26 of the bracket 24 is a mounting shaft 27 that freely supports a material shredder 28, the particulars of which are hereinafter more specifically described.

About the periphery of the open top hopper 17 is a casing 29 that houses the support structure for a movable protective shroud 30.

Figure 3:
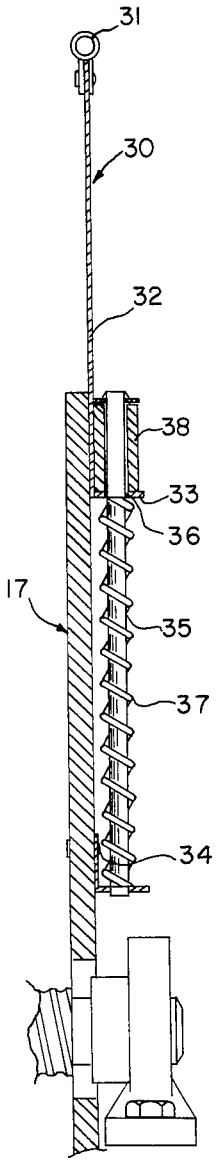
FIG. 3 is a fragmentary detailed side elevational view of the shroud construction and assembly.
Figure 9:
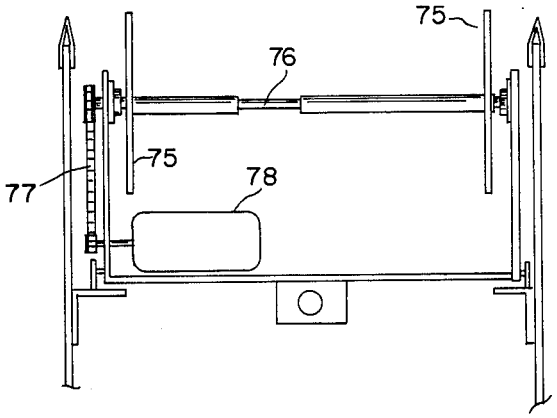
FIG. 9 is a fragmentary side elevational view of a head drive means for the modified structure of FIG. 7.

The shroud 30 as illustrated in FIGS. 2 and 3 consists of a continuous tubular gasket 31 mounted on the upper edge of a depending apron 32. The apron 32 has it's lower edge bent at a right angle to form a laterally projecting base 33.

Mounted to the exterior wall of the hopper 17 is a continuous "L" shaped support 34. Mounted upon this support 34 are a plurality of guide rods 35 extending parallelly to the walls of the hopper 17 while being equally spaced from each other.

As seen in FIG. 3, the base 33 of the apron 32 is provided with openings 36 through which the rods 35 are projected. An expansion spring 37 is journalled on each of the rods 35 and extends between the fixed support 34 and the base 33 of the apron 32. By this arrangement the shroud 30 may be forcibly positioned upon a designated surface area to be stripped or removed, so as to enclose the same during operation of the apparatus.

Mounted on each rod 35 is a stop in the form of a collar 38, that in turn bears upon the base 33 of the apron 32, to resist further upward movement thereof by the spring 37.

Referring to FIG. 1 it is seen that the chute 16 of the hopper 17 has communication with a collapsible bellows 39 which in turn has communication with a disposable bag 40 carried within the cabinet 11. The cabinet 11 through a suitable vacuum line is conditioned to draw into the shroud 30 and hopper 17 and through the chute 16, the surface material removed.

Figure 4:
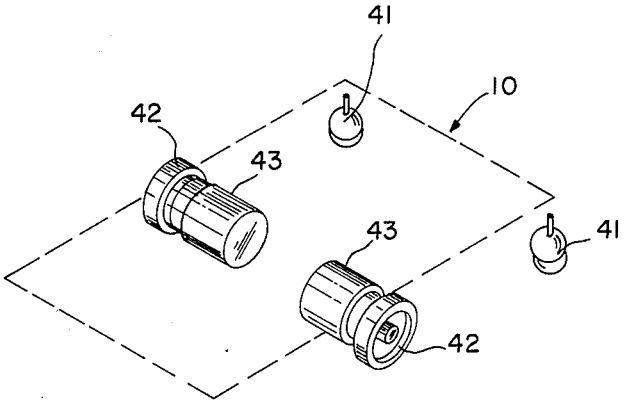
FIG. 4 is a schematic view of the drive arrangement for the assembly platform.

FIG. 4 illustrates a schematic system for rendering the apparatus portable. The cart 10 is provided at each corner with ball type swivel casters 41. A pair of independent wheels 42 are connected and driven by individual high torque reversible electric motors 43 carried beneath the cart 10 and situated between pairs of selected casters 41. Thus by independent energization of either of the motors 43 in either direction the cart may be moved or turned in any desired direction.

In operation the cart 10 may by remote control be moved so as to position the apparatus in a working position. The power lift mechanism 12 may be actuated so as to raise the hopper 17 until the gasket 30 has engaged and sealed a surface area. The electrical motor 22 may be energized so as to cause rotation of the worm type drive shaft 20 so as to move the material removing head 28 reciprocally through the hopper 17.

Figure 5:
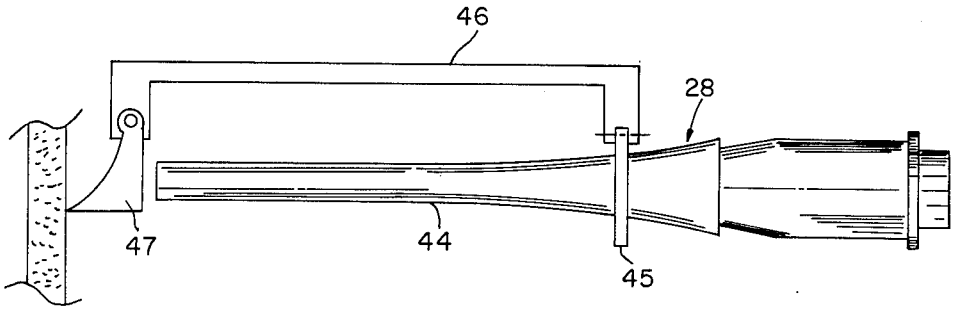
FIG. 5 is a side elevational view of one type of shredding tool employed in this invention.

In the embodiment of the device as illustrated in FIG. 1 the material removing head 28 may constitute a sonic, ultra sonic or ultra phonic signal emitter. As shown in FIG. 5 a signal emitter head 44 is mounted on a bracket 45 that may be pivotally attached to the shaft 27. Supported at one end on the bracket 45 is a U-shaped arm 46 which extends parallel to the elongated emitter head 44 as shown. A cutting tool 47 is pivotally attached to the free end of the arm 46 adjacent to the emitting end of the emitter head 44. By this arrangement when a signal is generated through the head 44 it will impinge upon the tool 45 and cause the same to penetrate into the material to be removed. In the event that the signal is staccato then the cutting head 47 will have a rapid tapping or cutting stroke into the material as it is moved back and forth across the worm gear 20 by the reversible electrical motor 23.

Figure 6:
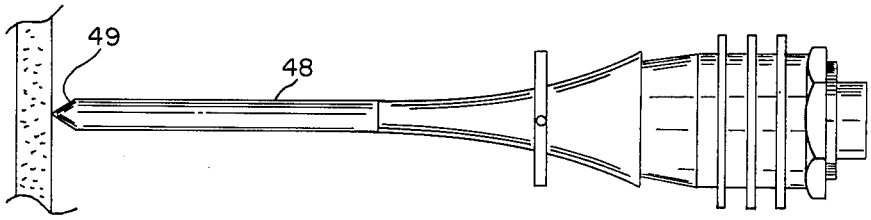
FIG. 6 is another form of shredding tool employed in this invention.

In FIG. 6 the emitter head is shown as at 48 and it has a concentrated emitting point 49 which is placed in close proximity to the material to be removed and through the signal generated therein will shred the material permitting it to fall into the hopper 17.

The sound frequencies may be transmitted directly to the material to be removed by the transducer or transmitter 48 placed in contact therewith such as is shown in FIG. 6. In the event that the transducer or emitter is coupled to a cutting tool such as that shown at 47 in FIG. 5 then the cutting tool will effect the removal of the material.

The suitable vacuum creating system is actuated effectively creating a negative pressure within the hopper 17 such that the removed material will be drawn therein through the chute 16 and the bellows 39 into the collecting disposable bag 40 carried within the cabinet 11.

Figure 7:
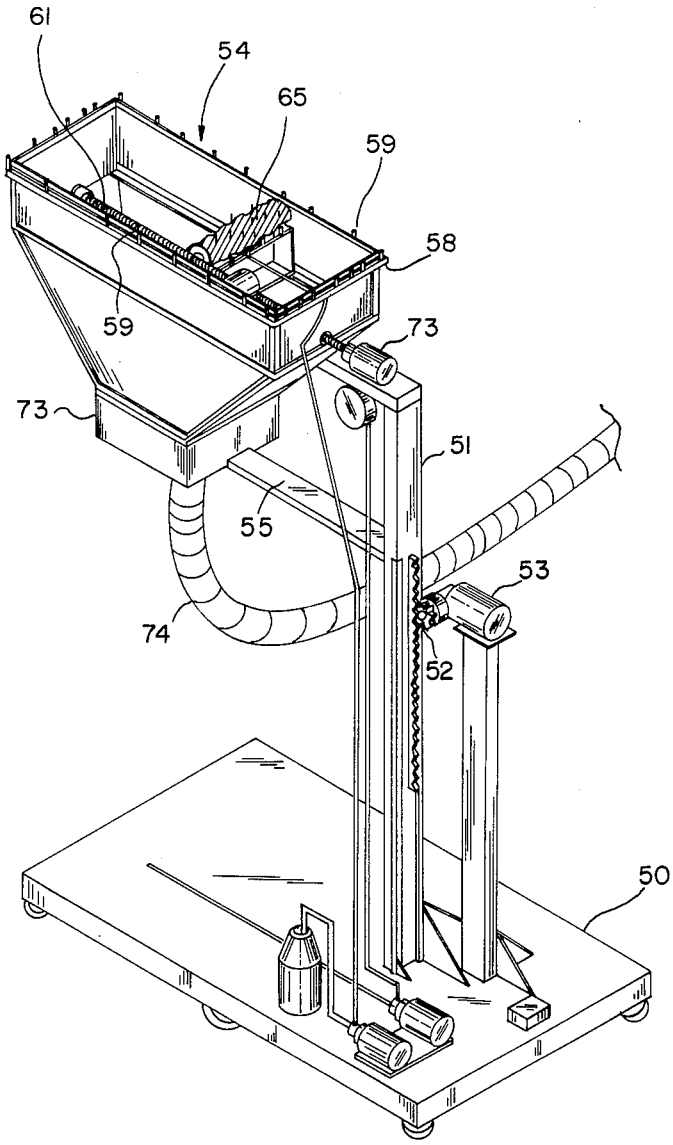
FIG. 7 is perspective view of a modified embodiment of the invention.

FIG. 7 discloses a modified assembly which includes a portable platform 50 which supports an adjustable standard 51 including a rack and pinion arrangement 52 operatable by a suitable power source 53 for raising and lowering a material receiving hopper 54. This hopper 54 is supported on the standard 51 by a suitable arm 55 extending at right angles from the standard 51 and movable therewith.

Figure 8:
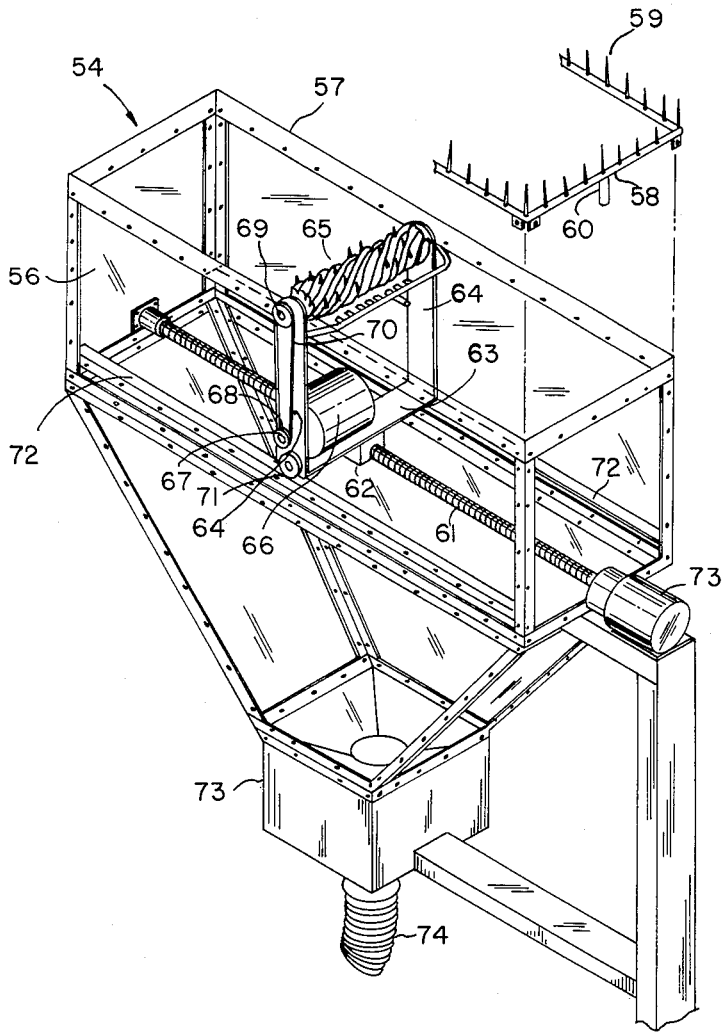
FIG. 8 is an enlarged view of the hopper and material shredder of the modified apparatus of FIG. 7.

As shown in FIG. 8 the hopper 54 has open communication with a box-like receptacle 56, the upper exposed peripheral edges of which are provided with a gasket 57. Also mounted about the peripheral edges is a tubular member 58 that is provided with a plurality of upwardly projecting hollow needles 59. The hollow tubular member 58 is connected to a suitable feed hose 60 which in turn may be associated with a hose reel not shown.

Within the receptacle 56 there is a worm drive 61 threaded through a block 62 that is connected to the underside of a supporting plate 63. This plate 63 in turn supports two vertical arms 64, which in turn, at their free ends support a rotatable planer 65. Situated on the plate 63 is a drive motor 66, the shaft 67 of which rotates a pulley 68. A like pulley 69 is mounted on the axle of the planer 65, and by a belt 70 will effect rotation of the planer 65 upon energization of the motor 66. To assist the worm drive 61 in supporting and moving the planer 65 reciprocally within the receptacle 56 there is provided a set of wheels 71 adapted to ride upon longitudinal tracks 72.

From the foregoing arrangement when the hopper is raised to engage a portion of a surface to be removed, the needles 59 will penetrate an area defined by the rectangular opening of the receptacle 56, so that suitable fluids may be inserted into the material to be removed. Simultaneously the gasket 57 will seal such a working area. Upon rotation of the gear drive 61 by the reversible electric motor 73 the planer 65 will be caused to move reciprocally through the receptacle 56. By energization of the motor 66 and the pulley drive hereinbefore described, the planer 65 will rotate and remove the undesired material. The removed material will fall into the hopper 73 and will be drawn into the vacuum tube 71 into a disposable container not shown.

In FIG. 7 there is shown a modified cutter head which includes two circular cutting blades 75 that are fixedly mounted upon a rotable shaft 76, which in turn through a chain drive arrangement 77, is caused to rotate when its power source 78 is actuated. This modified cutting head may be incorporated with either embodiment of the invention as previously described.

While I have illustrated and described the preferred form of construction for carrying my invention into effect, this is capable of variation and modification without departing from the spirit of the invention. I therefore, do not wish to be limited to the precise details of construction as set forth, but desire to avail myself of such variation and modifications as come within the scope of the appended claims.

Having thus described my invention, what I claim as new and desire to protect Letters Patent is:

1. An apparatus for removing and collecting disposable contaminated surface materials comprising:

(a) a movable platform for the apparatus, (b) an adjustable column vertically extending from said platform and supporting at its free end and material removal unit and a material collector, (c) said material collector comprising a receptacle having an open face defining a surface area to be treated, and a material collecting hopper surrounding an opposite open face of said receptacle, (d) a shroud movably attached about said open face of said receptacle, (e) means for movably attaching said shroud to said receptacle so as to yieldably position said shroud into contact with the surface to be treated, (f) a sealing gasket mounted on said shroud for sealing said defined surface area to be treated, (g) said material removing unit providing a material remover, a portion of which extends through said open face of said receptacle, (h) means for operating said material remover so as to remove surface material within said defined surface area, (i) means for reciprocally removing said material remover within said receptacle through the area to be treated, and (j) vacuum means connected to said hopper for withdrawing removed surface material from said receptacle with said sealing gasket preventing escape of said material into the ambient environment during its removal from the surface area being treated.

2. An apparatus for removing and collecting for disposal contaminated surface material, as defined by claim 1, including means for remotely propelling said platform in any direction relative to the surface to be treated.

3. An apparatus for removing and collecting for disposal contaminated surface material, as defined by claim 1, wherein said means for reciprocally moving material remover within said receptacle comprises a worm drive extending longitudinally through said receptacle movably supporting said material removing unit.

4. An apparatus for removing and collecting for disposal contaminated surface material, as defined by claim 1 wherein said material collector has communication with a disposable container for the removed material with said container disposed externally of said hopper.

5. An apparatus for removing and collecting for disposal contaminated surface material, as defined by claim 1 wherein said material remover comprises an ultrasonic emitter for dislocating the material, within the confines of said gasket, from the surface to be treated.

6. An apparatus for removing and collecting for disposal contaminated surface material, as defined by claim 1 including spring urged supporting means for yieldably maintaining said shroud above said open face of said receptacle for maintaining said gasket in sealing contact with the surface surrounding the area to be treated by said apparatus to prevent escape of the removed material into the ambient environment.

7. An apparatus for removing and collecting for disposal contaminated surface material, as defined by claim 1 including a fluid dispensing system for spraying and injecting coagulant liquid into the material to be removed within the area defined by said gasket.

8. An apparatus for removing and collecting for disposal contaminated surface material, as defined by claim 7 wherein said system includes dispensing needles disposed about the periphery of said receptacle through which said coagulant liquid is injected into the surrounding surface material to be removed.

* * * * *